US010910734B2

(12) United States Patent
Hamada et al.

(10) Patent No.: US 10,910,734 B2
(45) Date of Patent: Feb. 2, 2021

(54) SHIELDED CABLE WITH TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Kazuaki Hamada, Mie (JP); Atsushi Murata, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/490,051

(22) PCT Filed: Feb. 19, 2018

(86) PCT No.: PCT/JP2018/005670
§ 371 (c)(1),
(2) Date: Aug. 29, 2019

(87) PCT Pub. No.: WO2018/159351
PCT Pub. Date: Sep. 7, 2018

(65) Prior Publication Data

US 2020/0014129 A1 Jan. 9, 2020

(30) Foreign Application Priority Data

Mar. 1, 2017 (JP) ..... 2017-038120

(51) Int. Cl.
*H01R 4/20* (2006.01)
*H01R 4/18* (2006.01)
*H01R 4/58* (2006.01)

(52) U.S. Cl.
CPC ..... *H01R 4/185* (2013.01); *H01R 4/58* (2013.01)

(58) Field of Classification Search
CPC ..... H01R 4/20; H01R 9/05
(Continued)

(56) References Cited

U.S. PATENT DOCUMENTS 2,777,894 A * 1/1957 Arbeiter ..... H01R 24/40 174/750
5,468,911 A * 11/1995 Leve ..... H01R 4/20 174/73.1

(Continued)

FOREIGN PATENT DOCUMENTS

| | | |
|---|---|---|
| JP | 2002-208461 | 7/2002 |
| JP | 2006-244816 | 9/2006 |
| JP | 2010-182632 | 8/2010 |

OTHER PUBLICATIONS

International Search Report dated Mar. 13, 2018.

*Primary Examiner* — Chau N Nguyen
(74) *Attorney, Agent, or Firm* — Gerald E. Hespos; Michael J. Porco; Matthew T. Hespos

(57) ABSTRACT

A shielded cable/terminal assembly includes a shielded cable (10) with a braided wire (14) between wires (13) and an outer sheath (15). The braided wire (14) has a folded portion (18) formed by folding the braided wire (14) exposed from an end of the outer sheath (15) toward the outer sheath (15). A metal sleeve (19) is crimped to an outer surface of the outer sheath (15) inside the folded portion (18) in a radial direction of the shielded cable (10). A terminal (11) has a barrel (30) configured to sandwich the folded portion (18) between the sleeve (19) and the barrel (30), with the barrel (30) crimped to an outer surface of the folded portion (18). The barrel (30) has protrusions (32) projecting radially inward of the shielded cable (10) at positions behind a rear part of the sleeve (19) in an axial direction.

4 Claims, 7 Drawing Sheets

(58) Field of Classification Search
USPC ..... 174/75 C, 84 C
See application file for complete search history.

(56) References Cited

U.S. PATENT DOCUMENTS

| | | | | | |
|---|---|---|---|---|---|
| 5,679,926 | A * | 10/1997 | Maloney | B60R 16/0215 | 174/652 |
| 6,692,299 | B1 * | 2/2004 | Stockmaster | H01R 9/0518 | 439/578 |
| 7,044,756 | B1 * | 5/2006 | Asakura | H01R 9/032 | 439/607.41 |
| 9,496,071 | B2 * | 11/2016 | Nagahashi | B60R 16/0215 | |
| 9,865,942 | B2 * | 1/2018 | Hamada | H01R 4/20 | |
| 2015/0064992 | A1 * | 3/2015 | Kato | H01R 9/0524 | 439/879 |
| 2017/0323706 | A1 * | 11/2017 | Brueckner | H01B 7/40 | |

* cited by examiner

→ X

SHIELDED CABLE WITH TERMINAL

BACKGROUND

Field of the Invention

This specification relates to a shielded cable with a terminal connected to an end of the shielded cable.

Related Art

Japanese Unexamined Patent Publication No. 2002-208461 discloses a shielded cable with an outer conductor terminal connected to an end side of a shielded cable. This shielded cable and terminal assembly has a sleeve made of metal inserted between an insulating inner sheath covering around a core wire on the end side of the shielded cable and the outer conductor braided wire covering around the insulating inner sheath. The sleeve has a petal-shaped braided wire folding piece for folding an outer conductor braided wire on one end of a sleeve tube. The outer conductor braided wire folded outwardly by the braided wire folding piece is crimped and fixed by an outer conductor barrel integrally provided behind the outer conductor terminal having an inner conductor terminal connected to the core wire at the end of the shielded cable attached thereto.

According to the above configuration, the petal-shaped braided wire folding piece formed on an end edge of the sleeve butts against the crimped annular outer conductor barrel to prevent the withdrawal of the shielded cable. In this way, a fixing force of the shielded cable and the terminal is improved.

However, according to the above configuration, the petal-shaped braided wire folding piece formed on the end edge of the sleeve is shaped to project outward in a radial direction of the shielded cable, and this has caused a problem of enlarging the shielded cable and terminal assembly.

This specification was completed on the basis of the above situation and aims to suppress the enlargement of a shielded cable with terminal.

SUMMARY

The invention relates to a shielded cable and terminal assembly with a shielded cable that has a braided wire interposed between a core wire and an outer sheath. The braided wire is provided with a folded portion formed by folding the braided wire exposed from an end of the outer sheath toward the outer sheath. A sleeve made of metal and crimped to an outer surface of the outer sheath is disposed inside the folded portion in a radial direction of the shielded cable. The terminal of the assembly includes a barrel configured to sandwich the folded portion between the sleeve and the barrel with the barrel crimped to an outer surface of the folded portion. The barrel is formed with a protrusion projecting radially inwardly of the shielded cable at a position behind a rear end part of the sleeve in an axial direction of the shielded cable.

According to the above-described configuration, if the shielded cable is pulled rearward in the axial direction, the rear part of the sleeve crimped to the outer sheath of the shielded cable comes into contact with the protrusion formed on the barrel of the terminal from the front in the axial direction. In this way, a relative rearward movement of the shielded cable with respect to the terminal can be suppressed in the axial direction so that a fixing force of the terminal and the shielded cable can be improved.

The protrusion projects radially inwardly of the shielded cable according to the above configuration. Thus, the shielded cable and terminal assembly can be reduced in size as compared to the case where the protrusion projects radially outward of the shielded cable.

The barrel may have plural protrusions spaced apart in a circumferential direction of the shielded cable.

The braided wire is formed by braiding thin metal wires. Thus, a thickness of the folded portion of the braided wire may be uneven in the circumferential direction of the shielded cable due to the twist or shift of the thin metal wires. In such a case, a center axis of the shielded cable and a center axis of the barrel may deviate with the barrel of the terminal crimped to the shielded cable. Then, if the shielded cable is pulled rearward in the axial direction, the protrusion and the sleeve may not contact. According to the above-described configuration, even if the thickness of the folded portion becomes uneven in the radial direction of the shielded cable, at least one of the contacts the sleeve so that the fixing force of the terminal and the shielded cable can be improved.

A projecting dimension of the protrusion from the barrel in the radial direction may be set so that the protrusion does not contact the core wire. According to this configuration, the protrusion is not likely to penetrate the outer sheath to damage the core wire when the barrel is crimped to the outer surface of the folded portion.

The projecting dimension of the protrusion from the barrel in the radial direction may be set that the protrusion does not contact the outer sheath. According to this configuration, the damage of the outer sheath by the protrusion can be suppressed when the barrel is crimped to the outer surface of the folded portion.

According to the invention, it is possible to suppress the enlargement of a shielded cable with terminal.

DETAILED DESCRIPTION

Figure 1:
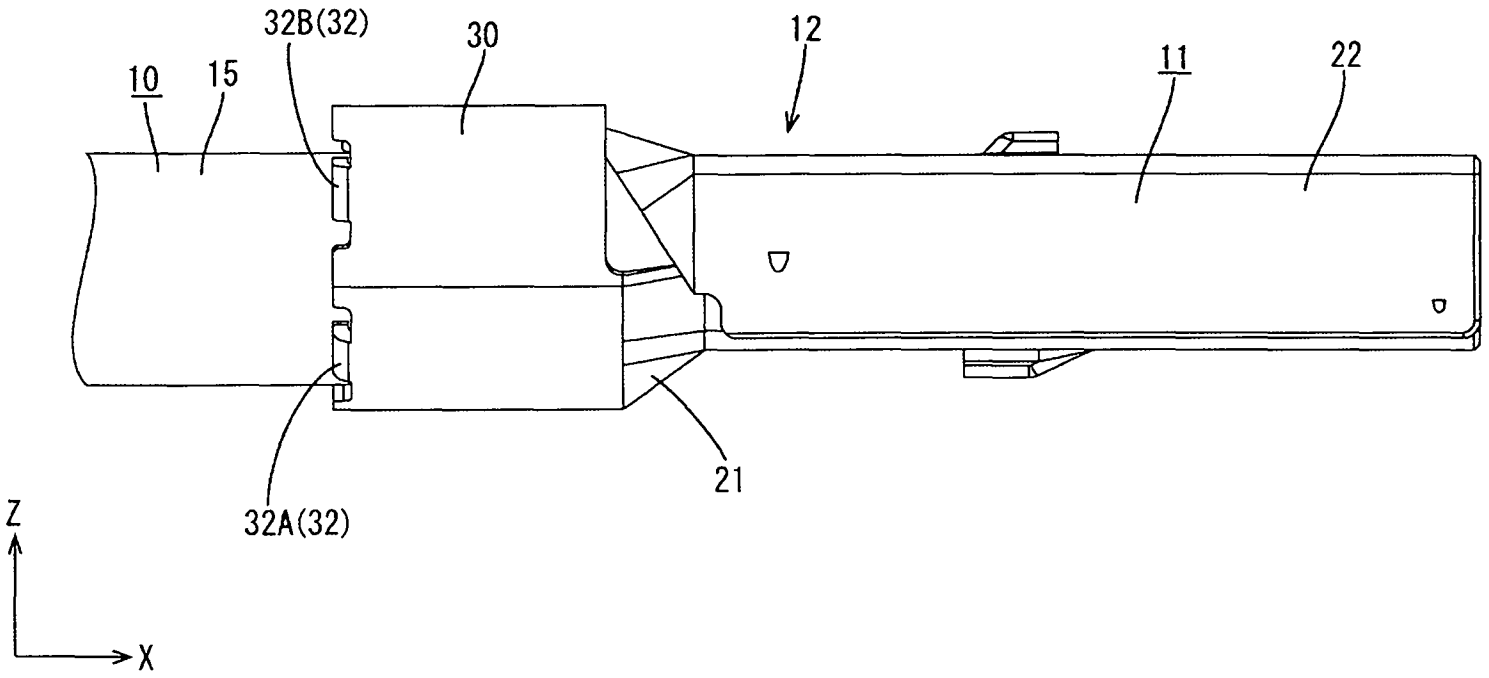
FIG. 1 is a side view showing a shielded cable with terminal according to an embodiment.

An embodiment of the invention is described with reference to FIGS. 1 to 7. As shown in FIG. 1, this embodiment relates to a shielded cable with terminal 12 in which a terminal 11 is connected to an end of a shielded cable 10. In the following description, an X direction is referred to as a forward direction, a Y direction is referred to as a rightward direction and a Z direction is referred to as an upward direction.

Shielded Cable 10

Figure 7:
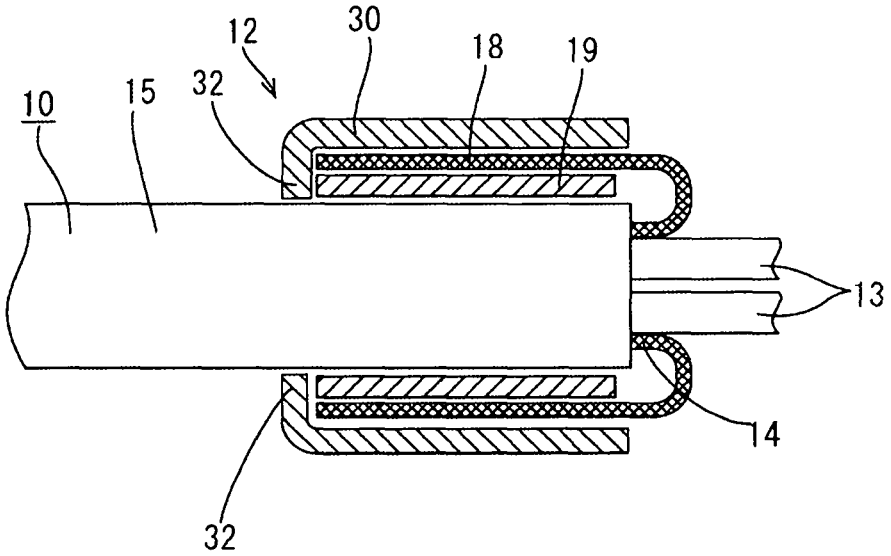
FIG. 7 is a view partly in section showing an engaging structure of protrusions and a sleeve.

As shown in FIG. 7, the shielded cable 10 includes wires 13 (two wires in this embodiment), a braided wire 14 surrounding the outer peripheries of the wires 13 and an outer sheath 15 made of insulating synthetic resin surrounding the outer periphery of the braided wire 14.

Figure 6:
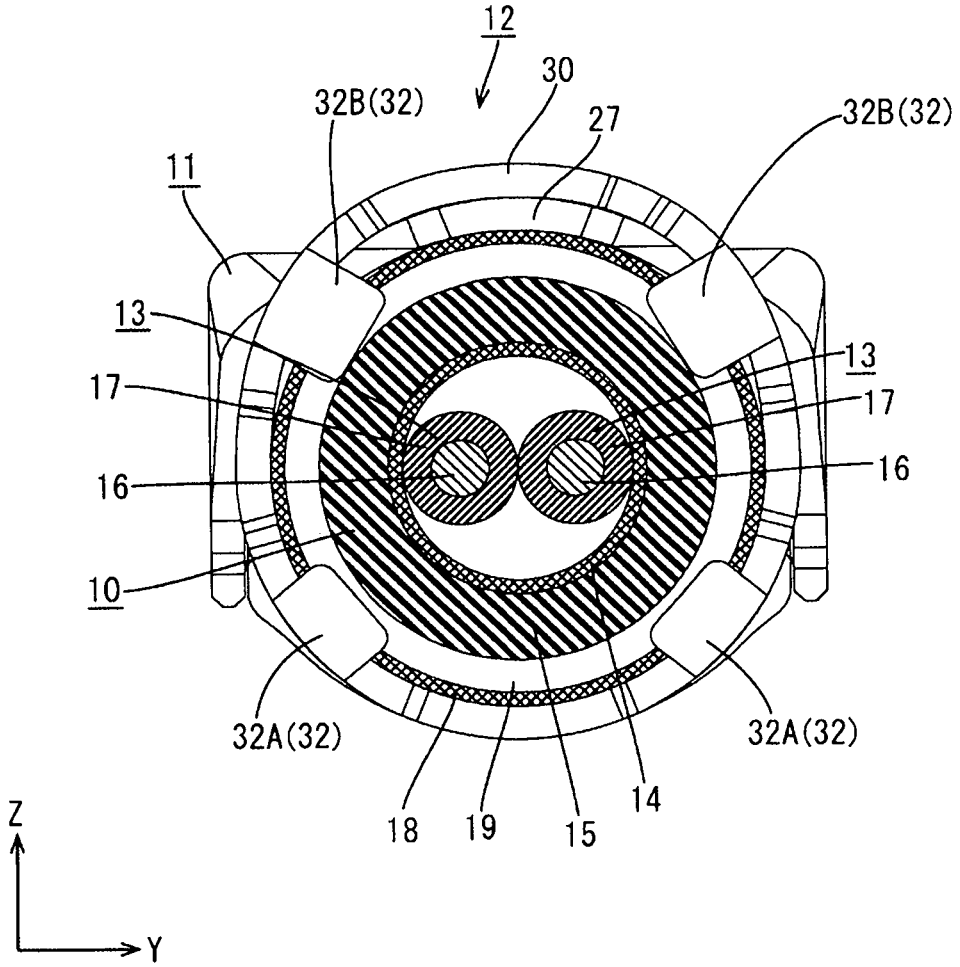
FIG. 6 is a back view showing the shielded cable with terminal.

As shown in FIG. 6, the wire 13 includes a core wire 16 and an inner sheath 17 made of insulating synthetic resin and surrounding the outer periphery of this core wire 16. A metal, such as copper, copper alloy, aluminum or aluminum alloy, can be selected according to need as a metal constituting the core wire 16. In this embodiment, copper or copper alloy is used. Two wires 13 are twisted with each other to form a twisted pair. An unillustrated inner conductor is connected to the tip of the wire 13.

The braided wire 14 is formed by braiding thin metal wires into a tubular shape. A metal, such as copper or copper alloy can be selected according to need as a metal of the thin metal wires. In this embodiment, copper or copper alloy is used.

As shown in FIG. 7, the outer sheath 15 of a front part (front end part in an axial direction of the shielded cable 10) of the shielded cable 10 is stripped. In this way, the wires 13 and the braided wire 14 are exposed from an end of the shielded cable 10. The braided wire 14 exposed from an end of the outer sheath 15 includes a folded portion 18 folded toward the end of the outer sheath 15. In other words, the folded portion 18 is shaped such that the braided wire 14 exposed forward in the axial direction from the front part of the outer sheath 15 is folded rearward in the axial direction. Note that the axial direction of the shielded cable 10 is described as a direction parallel to the front-rear direction in this embodiment.

The folded portion 18 is formed to overlap the outer sheath 15 of the shielded cable 10 from a radially outer side of the shielded cable 10.

Sleeve 19

Figure 2:
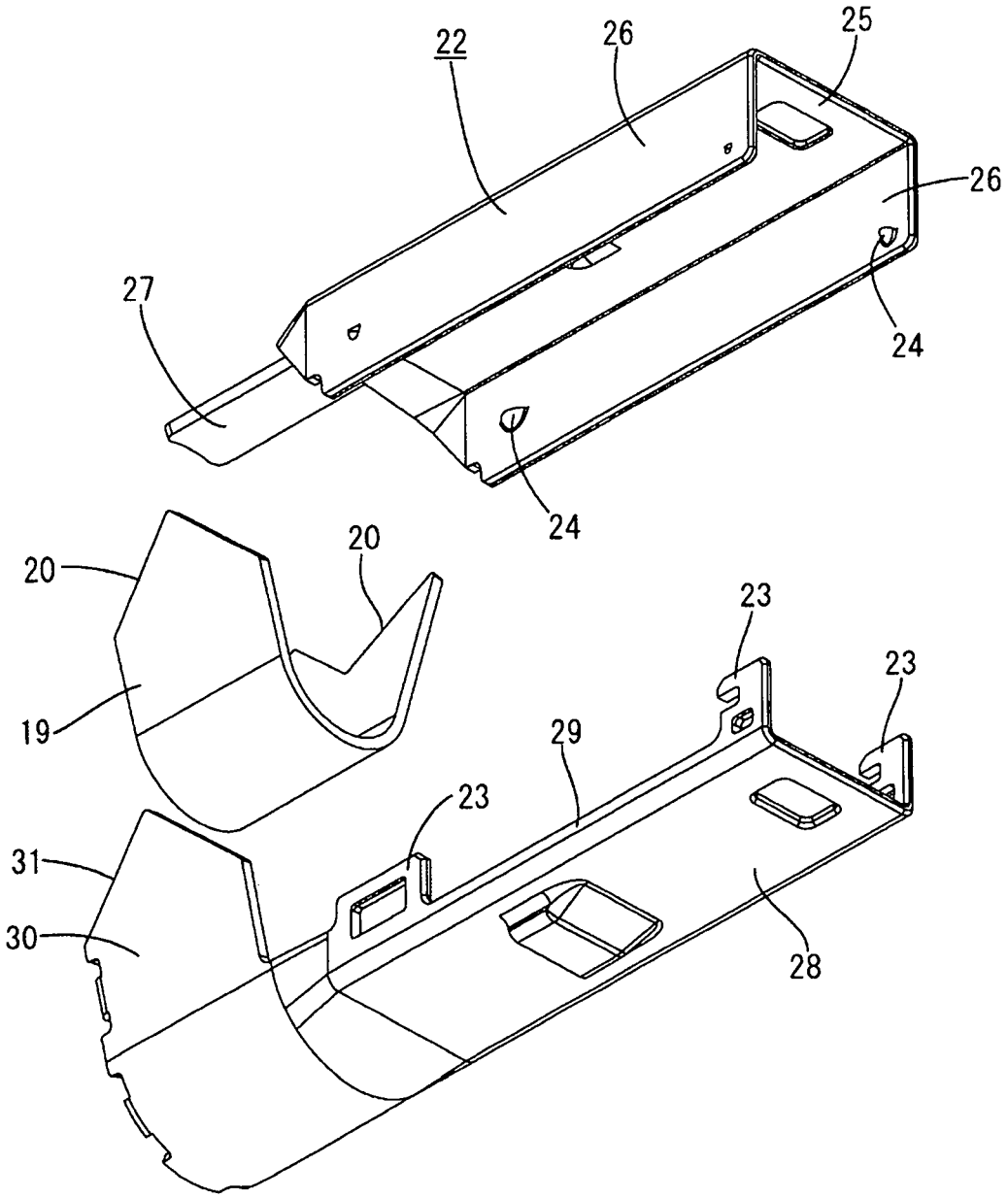
FIG. 2 is an exploded perspective view showing a terminal.
Figure 3:
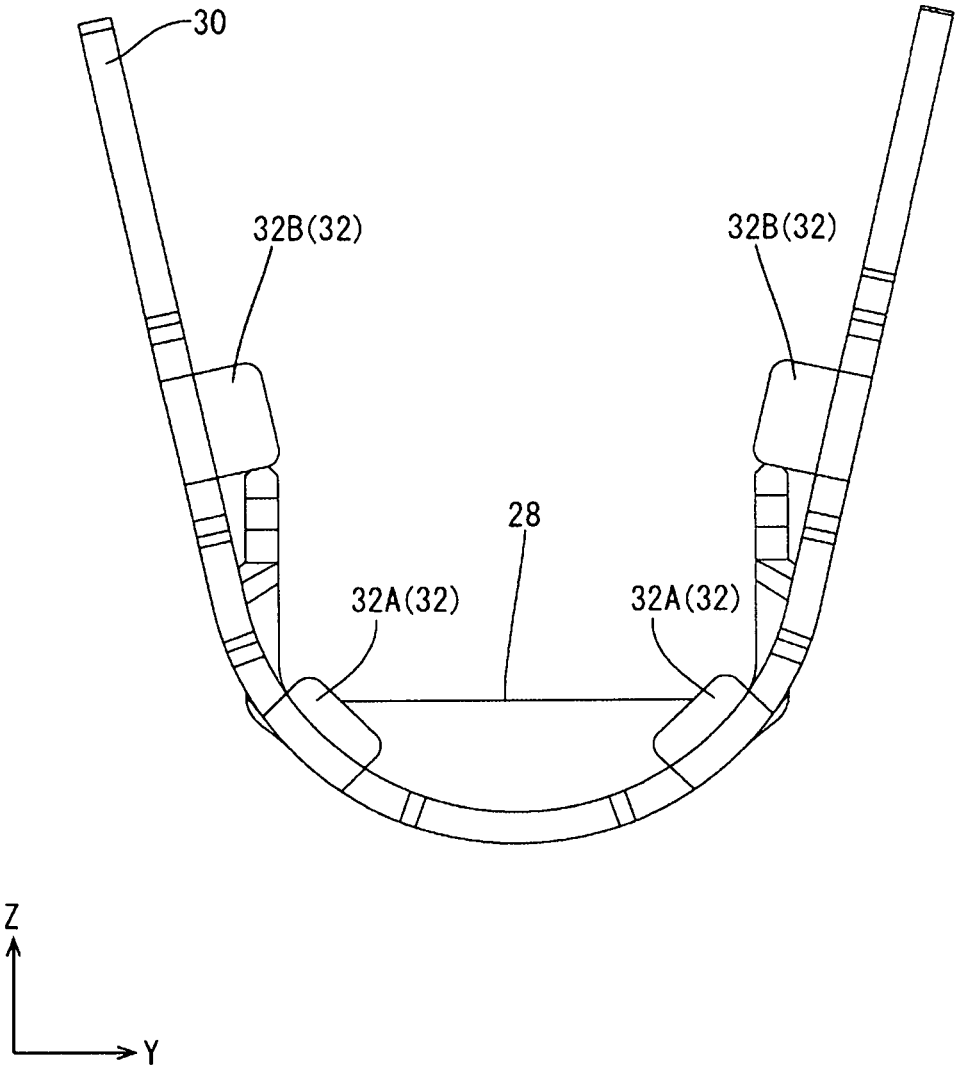
FIG. 3 is a back view showing a lower outer conductor.

As shown in FIG. 2, the sleeve 19 is formed by press-working a metal plate material into a predetermined shape. A metal, such as copper, copper alloy, aluminum or aluminum alloy, can be selected according to need as a metal constituting the sleeve 19. In this embodiment, copper or copper alloy is used.

The sleeve 19 is an elongated plate. Longitudinal end edges of the sleeve 19 serves as butting edge parts 20. One of the butting edge parts 20 is formed into a chevron shape when viewed laterally, and the other is formed into a valley shape. The butting edge parts 20 are formed so that a chevron-shaped part and a valley-shaped part are meshed with each other when the butting edge parts 20 butt against each other. The sleeve 19 is located outside the outer sheath 15 in a radial direction of the shielded cable 10 and is crimped to wind around the outer periphery of the outer sheath 15 at a position inside the folded portion 18.

With the sleeve 19 crimped to the outer sheath 15, the butting edge parts 20 butt against each other. The butting edge parts 20 butting against each other form a V shape when viewed from above. In this way, the thin metal wires of the braided wire 14 will not protrude into the inside of the sleeve 19 through a clearance between the both butting edge parts 20.

Terminal 11

The terminal 11 is formed by press-working a metal plate material into a predetermined shape. A metal, such as copper, copper alloy, aluminum or aluminum alloy, can be selected according to need as a metal of the terminal 11. In this embodiment, copper or copper alloy is used.

As shown in FIG. 2, the terminal 11 includes a lower outer conductor 21 disposed on a lower side and an upper outer conductor 22 to be mounted above the lower outer conductor 21. The lower outer conductor 21 is provided with lock receiving portions 23, whereas the upper outer conductor 22 is provided with locks 24 at positions corresponding to the lock receiving portions 23. The locks 24 resiliently engage the lock receiving portions 23 to assemble the lower outer conductor 21 and the upper outer conductor 22.

The upper outer conductor 22 includes an upper wall 25 having a substantially rectangular shape elongated in the front-rear direction and side walls 26 hanging down from both left and right side edges of the upper wall 25. The locks 24 are provided on the side walls 26.

A plate-like fixing piece 27 projects rearward on a rear end part of the upper wall 25. The fixing piece 27 has a rectangular shape elongated in the front-rear direction when viewed from above.

The lower outer conductor 21 includes a bottom wall 28 having a rectangular shape elongated in the front-rear direction when viewed from above, and side walls 29 extending up from left and right side edges of the bottom wall 28. The above-described receiving portions 23 are provided in the side walls 29. A barrel 30 is formed behind and continuously with the bottom wall 28.

The barrel 30 is formed into a plate elongated in a lateral direction and is crimped to wind around the folded portion 18 of the shielded cable 10 from outside to connect the terminal 11 and the shielded cable 10.

Figure 5:
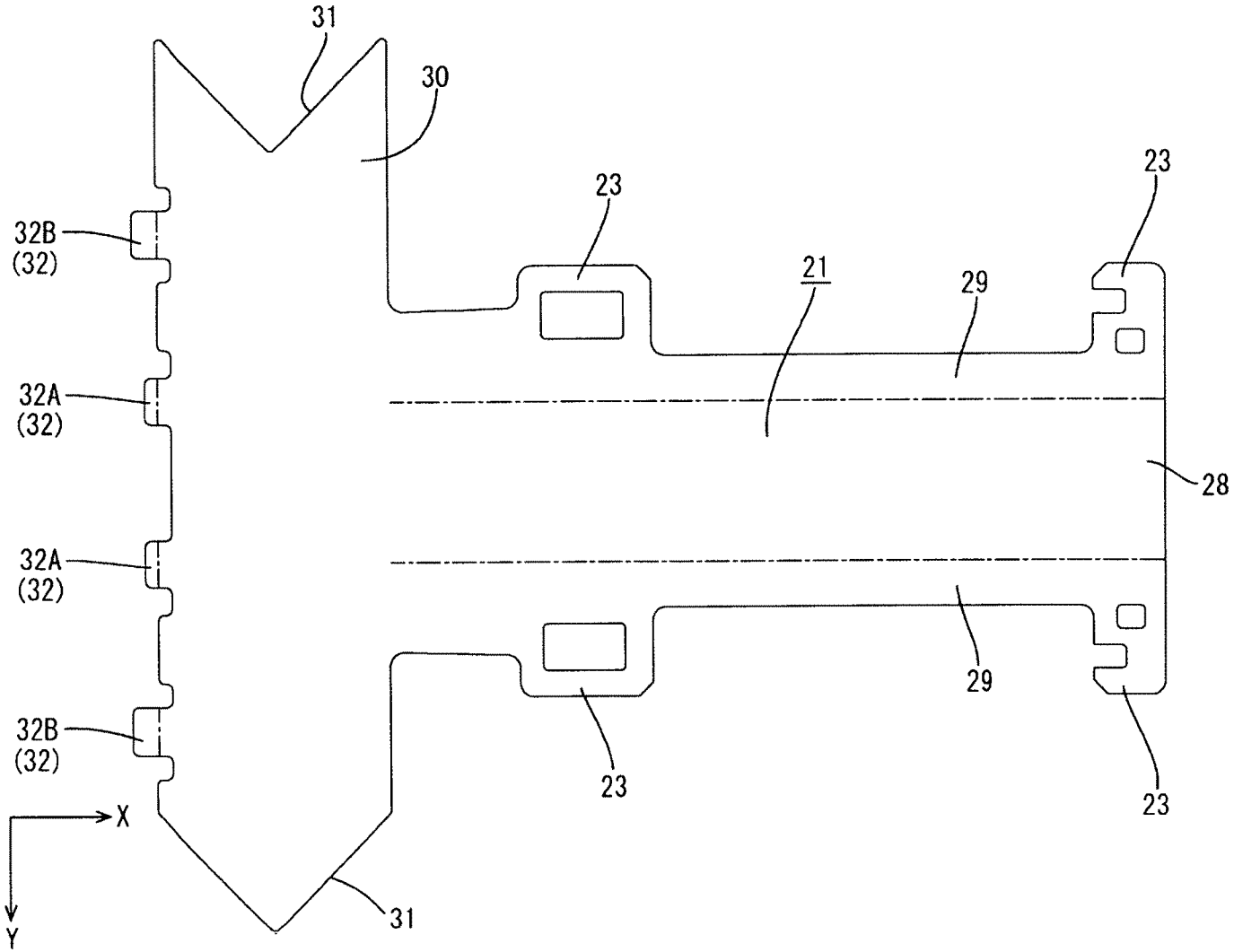
FIG. 5 is a development of the lower outer conductor.

As shown in FIG. 5, lateral end parts of the barrel 30 serve as butting edge parts 31 as in the case of the sleeve 19. One of the butting edges 31 is formed into a chevron shape when viewed laterally, and the other is formed into a valley shape. The butting edges 31 are formed so that a chevron-shaped part and a valley-shaped part are meshed with each other when the butting edges 31 butt against each other.

With the barrel 30 crimped to the folded portion 18, the butting edges 31 butt against each other. The butting edges 31 butting against each other form a V shape when viewed from above. In this way, the thin metal wires of the braided wire 14 will not protrude into the outside of the barrel 30 through a clearance between the butting edges 31.

As shown in FIG. 6, the fixing piece 27 of the upper outer conductor 22 is disposed at a position below an upper end part of the barrel 30 with the barrel 30 crimped to the folded portion 18. In other words, the fixing piece 27 is disposed between the folded portion 18 of the braided wire 14 and the barrel 30. Since the folded portion 18 of the braided wire 14 and the fixing piece 27 are sandwiched between the barrel 30 and the sleeve 19 in this way, the upper outer conductor 22 and the lower outer conductors 21 are assembled firmly.

Protrusions 32

As shown in FIG. 6, protrusions 32 (four in this embodiment) project radially inward of the shielded cable 10 while being spaced apart in a circumferential direction of the shielded cable 10. The protrusions 32 have a substantially rectangular shape with rounded corners when viewed from behind. The protrusions 32 are bent radially inwardly substantially at a right angle from the rear end edge of the barrel 30.

Figure 4:
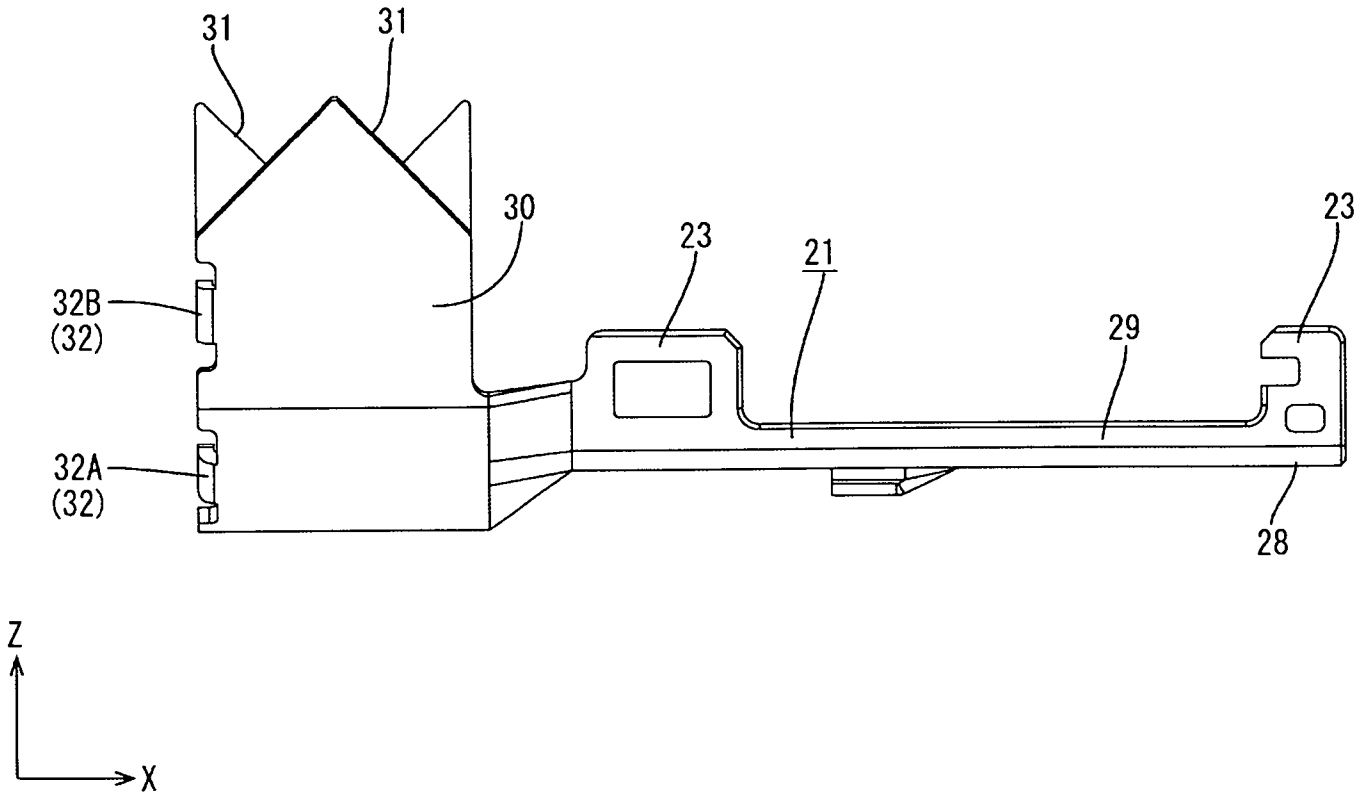
FIG. 4 is a side view showing the lower outer conductor.

As shown in FIG. 4, the rear edges of the protrusions 32 are substantially flush with the rear edge of the barrel 30. In other words, the protrusions 32 do not project rearward from the rear edge of the barrel 30. In this way, the protrusions 32 will not interfere with a tool for press-working the barrel 30.

FIG. 7 shows a view partly in section schematically showing an engaging structure of the protrusions 32 and the sleeve 19. As shown in FIG. 7, the protrusions 32 are at positions behind a rear part of the sleeve 19 in the axial direction of the shielded cable 10 with the barrel 30 crimped to the outer periphery of the folded portion 18. Inward projecting dimensions of the protrusions 32 in the radial direction of the shielded cable 10 are set so that the protrusions 32 are lockable to the rear end edge of the sleeve 19 from behind in the axial direction of the shielded cable 10 with the barrel 30 crimped to the outer periphery of the folded portion 18. In this way, the protrusions 32 contact the rear edge of the sleeve 19 from behind in the axial direction when a force for pulling the shielded cable 10 rearward in the axial direction is applied to the shielded cable 10

The rear end edge of the sleeve 19 and the front surfaces of the protrusions 32 may be in contact or may be separated in a state where the shielded cable 10 is not pulled rearward in the axial direction.

The protrusions 32 on the rear end part of the barrel 30 are bilaterally symmetrically disposed when viewed from behind. In this way, the sleeve 19 can be received by the bilaterally symmetrically disposed protrusions 32 when the shielded cable 10 is pulled rearward in the axial direction. Thus, a force will not be biased toward a specific protrusion 32.

As shown in FIGS. 5 and 6, the four protrusions 32 are set such that the two protrusions 32B located on an upper side project more from the barrel 30 than the two protrusions 32A located on a lower side. This is because the fixing piece 27 of the upper outer conductor 22 is disposed below the upper end part of the barrel 30 and an interval between the barrel 30 and the sleeve 19 is wider by a thickness of this fixing piece 27, as shown in FIG. 6. By setting the two protrusions 32B located on the upper side to project more from the barrel 30 than the protrusions 32A located on the lower side, the protrusions 32 can reliably come into contact with the sleeve 19.

Manufacturing Method of Shielded Cable with Terminal 12

Next, an example of a manufacturing process of the shielded cable with terminal 12 is described. Note that the manufacturing process of the shielded cable with terminal 12 is not limited to the following process.

The outer sheath 15 of the shielded cable 10 is stripped by a predetermined length so that, the wires 13 and the braided wire 14 are exposed from the outer sheath 15.

Subsequently, the sleeve 19 is crimped at a position near the front part of the outer sheath 15. At this time, the butting edges 20 of the sleeve 19 are butted against each other.

Subsequently, the braided wire 14 exposed from the front part of the outer sheath 15 is folded toward the front end part of the outer sheath 15. In other words, the braided wire 14 exposed from the front part of the outer sheath 15 is folded rearward in the axial direction of the shielded cable 10. In this way, the folded portion 18 is formed outside the sleeve 19 in the radial direction of the shielded cable 10.

On the other hand, the lower outer conductor 21 and the upper outer conductor 22 are assembled integrally by resiliently engaging the lock receiving portions 23 of the lower outer conductor 21 and the locks 24 of the upper outer conductor 22. Subsequently, the folded portion 18 of the shielded cable 10 is placed on the barrel 30. At this time, the fixing piece 27 is located above the folded portion 18.

The barrel 30 is crimped to wind around the outer periphery of the folded portion 18. In this way, the butting edge parts 31 are butted against each other. At this time, the fixing piece 27 is disposed below the barrel 30, and the fixing piece 27 and the folded portion 18 are sandwiched between the sleeve 19 and the barrel 30. In this way, the shielded cable with terminal 12 is completed.

Functions and Effects of Embodiment

The shielded cable with terminal 12 according to this embodiment includes the shielded cable 10 in which the braided wire 14 is interposed between the wires 13 and the outer sheath 15, and the braided wire 14 is provided with the folded portion 18 formed by folding the braided wire 14 exposed from the end of the outer sheath 15 toward the outer sheath 15. The sleeve 19 is made of metal and is crimped to the outer surface of the outer sheath 15 inside the folded portion 18 in the radial direction of the shielded cable 10. Additionally, the terminal 11 has the barrel 30 configured to sandwich the folded portion 18 between the sleeve 19 and the barrel 30 with the barrel 30 crimped to the outer surface of the folded portion 18. Additionally, the barrel 30 is formed with the protrusions 32 projecting radially inwardly of the shielded cable 10 at the positions behind the rear end part of the sleeve 19 in the axial direction of the shielded cable 10.

According to the above configuration, if the shielded cable 10 is pulled rearward in the axial direction, the rear end part of the sleeve 19 crimped to the outer sheath 15 of the shielded cable 10 contacts the protrusions 32 formed on the barrel 30 of the terminal 11 from front in the axial direction. In this way, a relative rearward movement of the shielded cable 10 with respect to the terminal 11 can be suppressed in the axial direction, and a fixing force of the terminal 11 and the shielded cable 10 can be improved.

Further, since the protrusions 32 project radially inward of the shielded cable 10 according to the above configuration, the shielded cable with terminal 12 can be reduced in size as compared to the case where the protrusions 32 project radially outward of the shielded cable 10.

Further, the barrel 30 is provided with the protrusions 32 spaced apart in the circumferential direction of the shielded cable 10. Since the braided wire 14 is formed by braiding the thin metal wires, a thickness of the folded portion 18 of the braided wire 14 may be uneven in the circumferential direction of the shielded cable 10 due to the twist or shift of the metal thin wires. In such a case, a center axis of the shielded cable 10 and a center axis of the barrel 30 may deviate with the barrel 30 of the terminal 11 crimped to the shielded cable 10. Then, if the shielded cable 10 is pulled rearward in the axial direction, the protrusions 32 and the sleeve 19 may not contact. According to the above configuration, even if the thickness of the folded portion 18 becomes uneven in the radial direction of the shielded cable 10, at least one of the protrusions 32 comes into contact with the sleeve 19 so that the fixing force of the terminal 11 and the shielded cable 10 can be reliably improved.

Further, the projecting dimensions of the protrusions 32 from the barrel 30 in the radial direction of the shielded cable 10 are set that the protrusions 32 do not contact the wires 13

According to the above configuration, the protrusions 32 penetrate through the outer sheath 15 to damage the wires 13 when the barrel 30 is crimped to the outer surface of the folded portion 18. In this embodiment, the two wires 13 are formed into a twisted pair and electrical signals flow in the wires 13. Thus, a structure for preventing the contact of the protrusions 32 with the wires 13 is particularly effective.

Further, the projecting dimension of the protrusions 32A from the barrel 30 in the radial direction of the shielded cable 10 is set that the protrusions 32A do not contact the outer sheath 15. According to the above configuration, damage to the outer sheath 15 by the protrusions 32A can be suppressed when the barrel 30 is crimped to the outer surface of the folded portion 18.

The invention is not limited to the above described and illustrated embodiment. For example, the following embodiments also are included in the scope of the invention.

Although the wires 13 are a twisted pair in the above embodiment, there is no limitation to this and one wire 13 or three or more wires 13 may be provided.

One, three, three, five or more protrusions 32 may be provided.

The projecting dimensions of the protrusions 32 from the barrel 30 in the radial direction of the shielded cable 10 may be set such that the protrusions 32 can come into contact with at least a part of the rear end part of the sleeve 19 from behind in the axial direction of the shielded cable 10.

Although the both butting edge parts 31 of the barrel 30 form a V shape with the barrel 30 crimped to the folded portion 18 in the above embodiment, there is no limitation to this and the butting edge parts may form an arbitrary shape such as a linear shape, a wavy shape or a crank shape. Further, although the both butting edge parts 20 of the sleeve 19 form a V shape with the sleeve 19 crimped to the shielded cable 10, there is no limitation to this and the butting edge parts may form an arbitrary shape such as a linear shape, a wavy shape or a crank shape.

Although the terminal 11 is formed by integrally assembling the upper outer conductor 21 and the lower outer conductor 22 in the above embodiment, there is no limitation to this and the terminal 11 may be formed by integrally connecting the barrel 30 to a tubular portion.

Intervals between the protrusions 32 may be equal intervals or unequal intervals.

LIST OF REFERENCE SIGNS

10: shielded cable
11: terminal
12: shielded cable with terminal
13: wire
14: braided wire
15: outer sheath
18: folded portion
19: sleeve
30: barrel
32: protrusion

The invention claimed is:

1. A shielded cable with terminal, comprising:

a shielded cable in which a braided wire is interposed between a core wire and an outer sheath and the braided wire is provided with a folded portion formed by folding the braided wire exposed from an end of the outer sheath toward the outer sheath;

a sleeve made of metal and crimped to an outer surface of the outer sheath inside the folded portion in a radial direction of the shielded cable; and a terminal including a barrel configured to sandwich the folded portion between the sleeve and the barrel with the barrel crimped to an outer surface of the folded portion;

the barrel being formed with a protrusion projecting radially inwardly of the shielded cable at a position behind a rear end part of the sleeve in an axial direction of the shielded cable; and the terminal being provided with a fixing piece projecting rearward in the axial direction, the fixing piece being disposed between the folded portion of the braided wire and the barrel with the barrel crimped to the folded portion, wherein a projecting dimension of the protrusion from the barrel in the radial direction is so set that the protrusion does not contact the outer sheath.

2. A shielded cable with terminal, comprising:

a shielded cable in which a braided wire is interposed between a core wire and an outer sheath, and the braided wire is provided with a folded portion formed by folding the braided wire exposed from an end of the outer sheath toward the outer sheath;

a sleeve made of metal and crimped to an outer surface of the outer sheath inside the folded portion in a radial direction of the shielded cable, the sleeve having a front end facing the fold and a rear end spaced from the front end along an axial direction of the shielded cable; and a terminal formed separately from the sleeve and including a barrel configured to sandwich the folded portion of the braided wire between the sleeve and the barrel with the barrel crimped to an outer surface of the folded portion;

a protrusion formed integrally with the barrel of the terminal and separately from the sleeve, the protrusion projecting radially inwardly from the barrel toward the shielded cable at a position behind the rear end of the sleeve; and the terminal being provided with a fixing piece projecting rearward in the axial direction, the fixing piece being disposed between the folded portion of the braided wire and the barrel with the barrel crimped to the folded portion, wherein the terminal includes a lower outer conductor and an upper outer conductor that are assembled to one another, the fixing piece being integral with the upper outer conductor, the barrel being integral with the lower outer conductor.

3. The shielded cable with terminal of claim 2, wherein the terminal has opposite front and rear ends, the protrusion of the barrel being at the rear end of the terminal, the front end of the terminal projecting forward of the folded portion of the braided wire.

4. The shielded cable with terminal of claim 2, wherein the barrel is crimped into engagement with the fixing piece and into engagement with areas of the folded portion of the braided wire spaced circumferentially from the fixing piece.

* * * * *